US006748830B1

(12) United States Patent
Swanstrom, Jr.

(10) Patent No.: US 6,748,830 B1
(45) Date of Patent: Jun. 15, 2004

(54) THREADED GRIPPING BAR PLIERS INSERT

(75) Inventor: John E. Swanstrom, Jr., Duluth, MN (US)

(73) Assignee: Swanstrom Tools USA, Inc., Superior, WI (US)

( * ) Notice: Subject to any disclaimer, the term of this patent is extended or adjusted under 35 U.S.C. 154(b) by 0 days.

(21) Appl. No.: 09/460,142

(22) Filed: Dec. 13, 1999

(51) Int. Cl.[7] ..... B25B 7/02

(52) U.S. Cl. ..... 81/423; 81/426; 269/262; 269/282

(58) Field of Search ..... 81/423, 422, 421, 81/424.5, 426, 186; 269/262, 268, 269, 271, 272, 273, 282

(56) References Cited

U.S. PATENT DOCUMENTS 234,304 A * 11/1880 Lovrien ..... 81/423
2,693,726 A * 11/1954 Coonan
3,156,087 A * 11/1964 Granberg
4,183,571 A * 1/1980 Renfroe ..... 269/271
4,576,067 A * 3/1986 Buck ..... 81/421
5,211,049 A * 5/1993 Lucas
5,485,770 A * 1/1996 Popelak

* cited by examiner

*Primary Examiner*—D. S. Meislin
(74) *Attorney, Agent, or Firm*—Faegre & Benson LLP

(57) ABSTRACT

A pliers having a replaceable gripping member for pliers jaws in the form of a threaded cylinder received in a threaded bore with part of the threaded cylinder extending out of the jaw in which it is mounted to provide a gripping surface formed of a segment of the threaded cylinder. The mating jaw has a recess to receive the projecting segment. A method of renewing the gripping surface includes rotating the threaded member to expose a different portion of the threads in the projecting segment, after removal of damaged threads in the projecting segment by filing the cylinder, if necessary. A hexagonal recess is formed in the end of the cylinder to enable installation, renewal of the segment and replacement of the entire cylinder using an Allen wrench. For non-sparking applications, the pliers are formed of aluminum bronze and the gripping member is formed of beryllium copper.

20 Claims, 13 Drawing Sheets

THREADED GRIPPING BAR PLIERS INSERT

FIELD OF THE INVENTION

This invention relates to the field of hand tools designed for gripping, such as pliers.

BACKGROUND OF THE INVENTION

In the past, gripping tools such as pliers typically had serrations permanently formed in the jaws thereof to provide increased ability to grip objects placed in the jaws of such tools. Typically those serrations were formed in the bulk material of the jaws. As a consequence, the hardness and resistance to wear were a function of the bulk material from which the jaws (and usually the rest of the tool) were made. Typically there are somewhat conflicting ideals for the material properties of the jaws and handles of such tools. Jaws often are desired to be hard and wear resistant, while handles are most often desired to have good tensile strength and fracture resistance, and usually do not need to be particularly wear resistant. If the jaws and the handles are made from the same bulk material, compromises in the desired material properties often must be made. Furthermore, typical pliers jaws (even with serrations) have opposed planar surfaces which come together to grip work objects. This is typically true even in pliers that may have replaceable inserts in the jaws. Many pliers have their serrated teeth formed by a broaching operation, with economies of production dictating shallow depth for the serrations. Again, typically, the jaw serrations are not hardened beyond the base overall tool body hardness, although it has been observed that some "linesman" type pliers have had their jaws induction hardened.

DETAILED DESCRIPTION OF THE INVENTION

Figure 1:
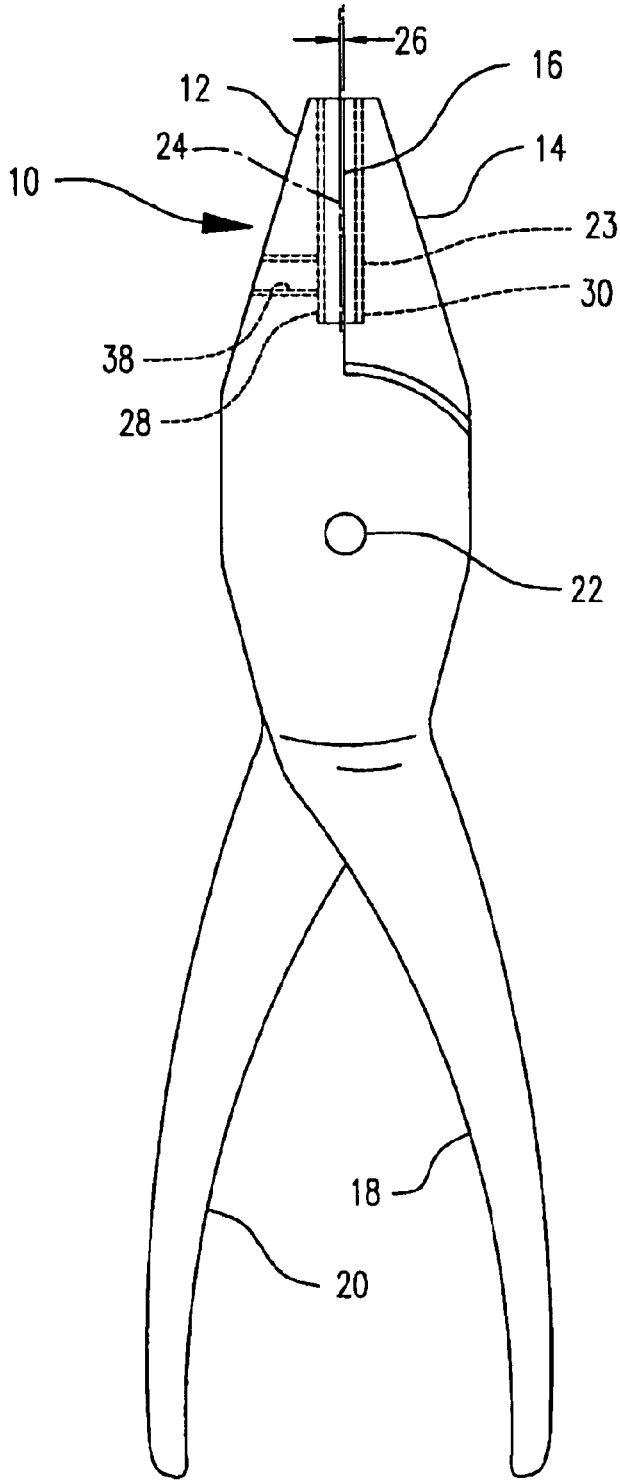
FIG. 1 is a top view of a pliers useful in the practice of the present invention with the jaws closed.
Figure 2:
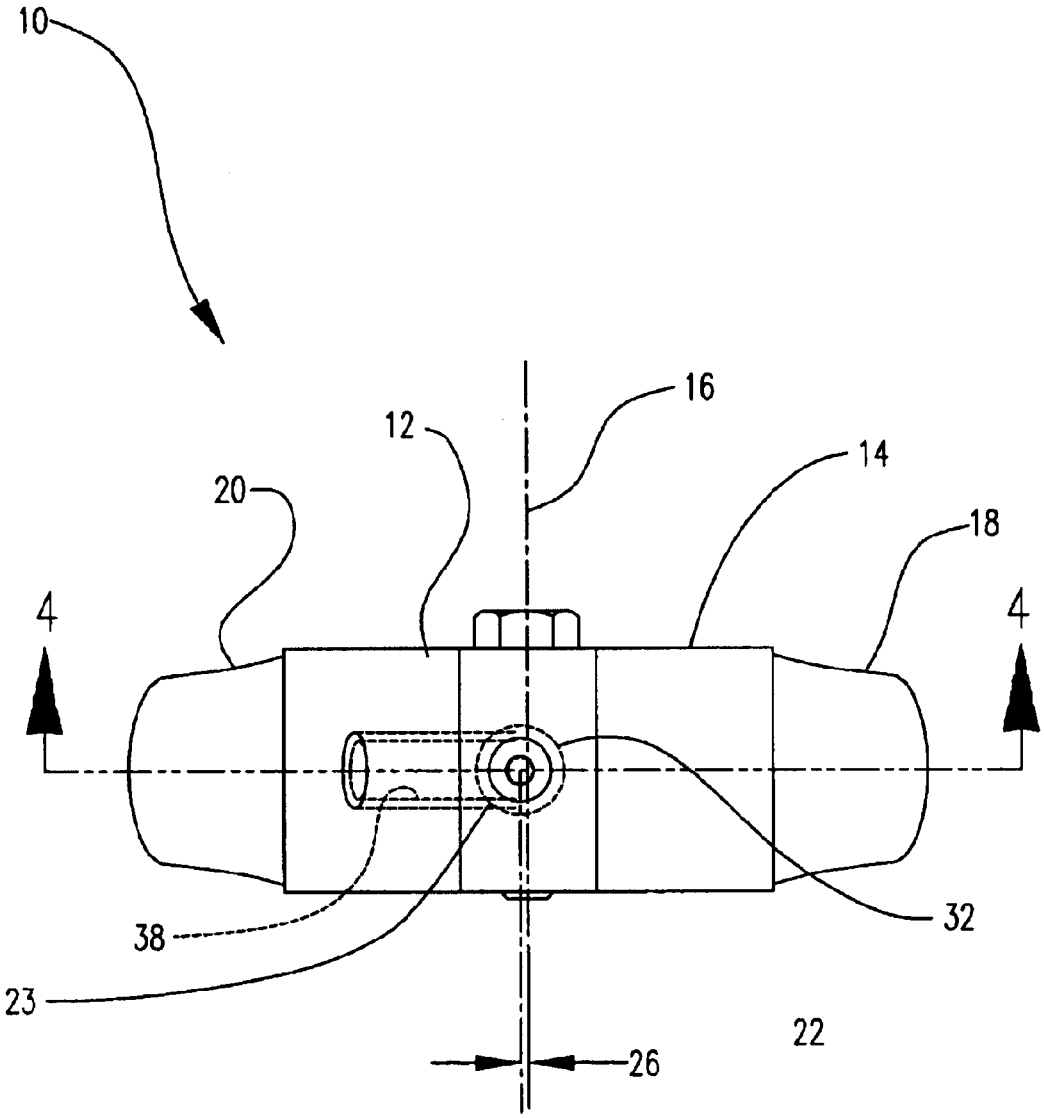
FIG. 2 is an end view of the pliers of FIG. 1.
Figure 3:
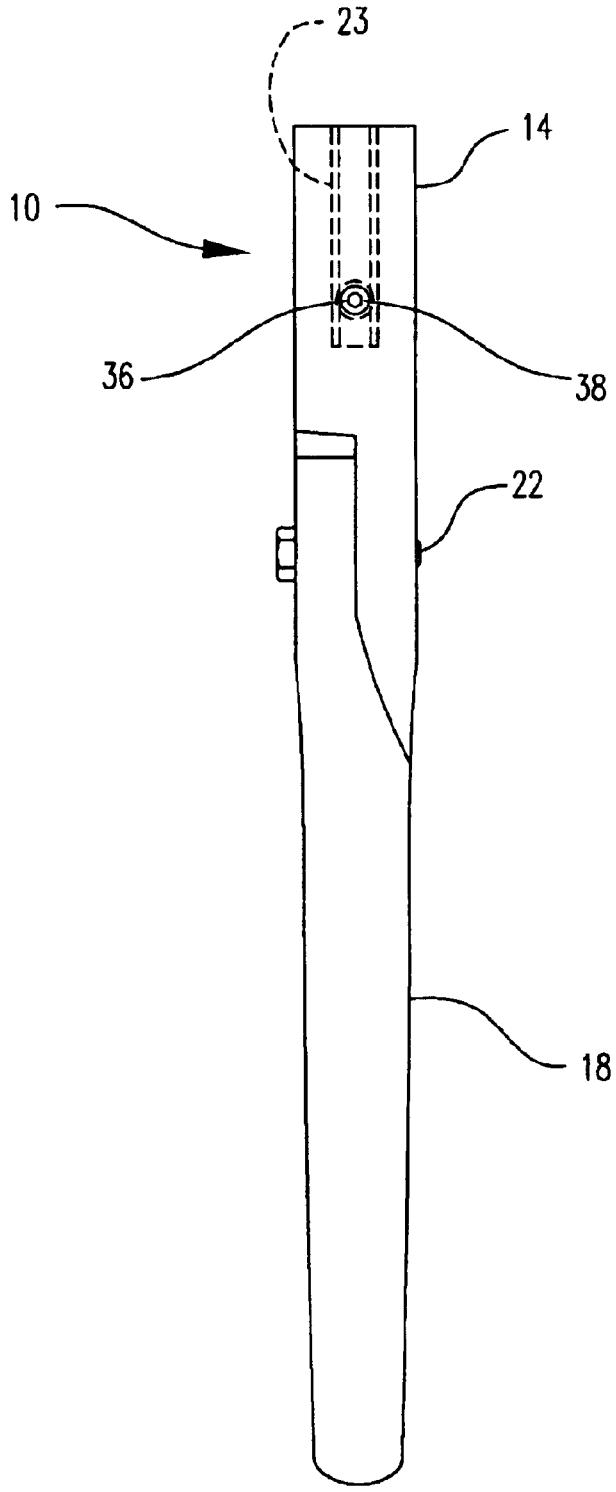
FIG. 3 is a side view of the pliers of FIG. 1.

Referring now to the Figures, and most particularly, to FIGS. 1, 2, and 3, a pliers 10 useful in the practice of the present invention is shown in various views. Although shown in the form of lineman's pliers, it is to be understood that the present invention is useful in other forms of pliers, notably (but not limited to) slip joint pliers, long nose pliers, duck bill pliers, and the like. It is to be understood that the present invention has particular usefulness in specialty tools such as those directed to non-sparking, non-scratching, or non-magnetic applications, such as pliers made from bronze or other copper alloys which are not able to be easily hardened. It is typical for such tools to be manufactured from a bronze material having a typical hardness of HRC 30, which is quite soft and subject to rapid wear and deterioration when machined or otherwise formed to have relatively sharp serrations or teeth in the jaws initially suitable for strong gripping duty.

Pliers 10 preferably have first and second moveable opposed jaws 12, 14 meeting at a closing plane 16 for gripping. Pliers 10 also have handles 18, 20 preferably formed integrally with the jaws for opening and closing the jaws. A pivot member 22, such as a screw or rivet or the like pivotably secures the movable parts of the pliers together, permitting reciprocable motion to open and close the jaws 12 and 14 by operating the handles 18 and 20 about the pivot member 22.

Figure 4:
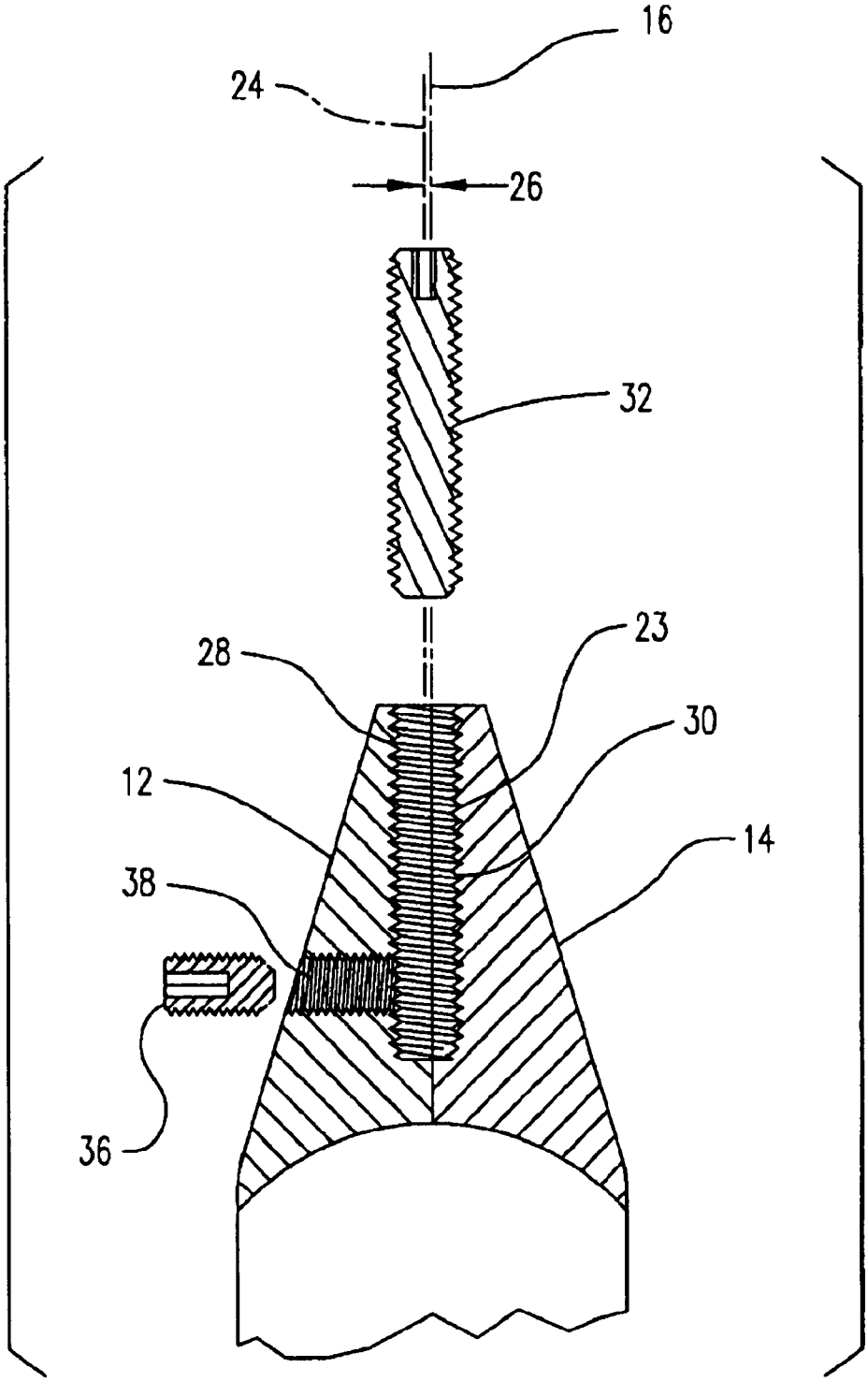
FIG. 4 is an exploded fragmentary section view of the jaws of the pliers of FIG. 1, showing an insert and set screw useful in the practice of the present invention.
Figure 5:
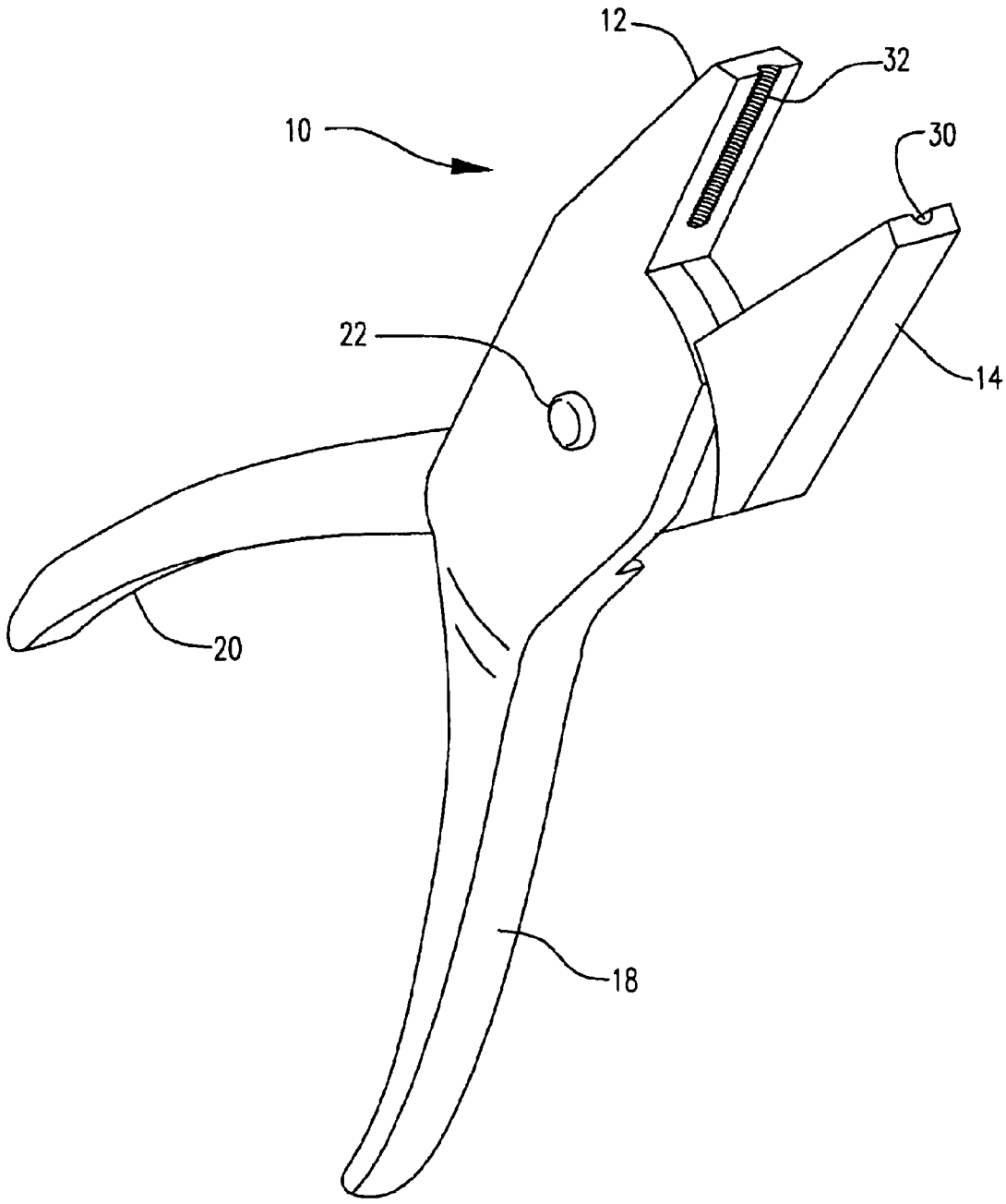
FIG. 5 is a perspective view of the pliers of FIG. 1 with the jaws open.

Referring now also to FIG. 4, a bore 23 is located in the jaws and has an centered axis 24 that is offset by a predetermined distance 26 from the closing plane 16. It is to be understood that the closing plane 16 intersects a cross section of bore 23 such that a majority portion 28 of the bore 23 is in the first jaw 12 on one side of the closing plane 16 and a minority portion 30 is in the second jaw 14 on the other side of the closing plane 16.

Figure 6:
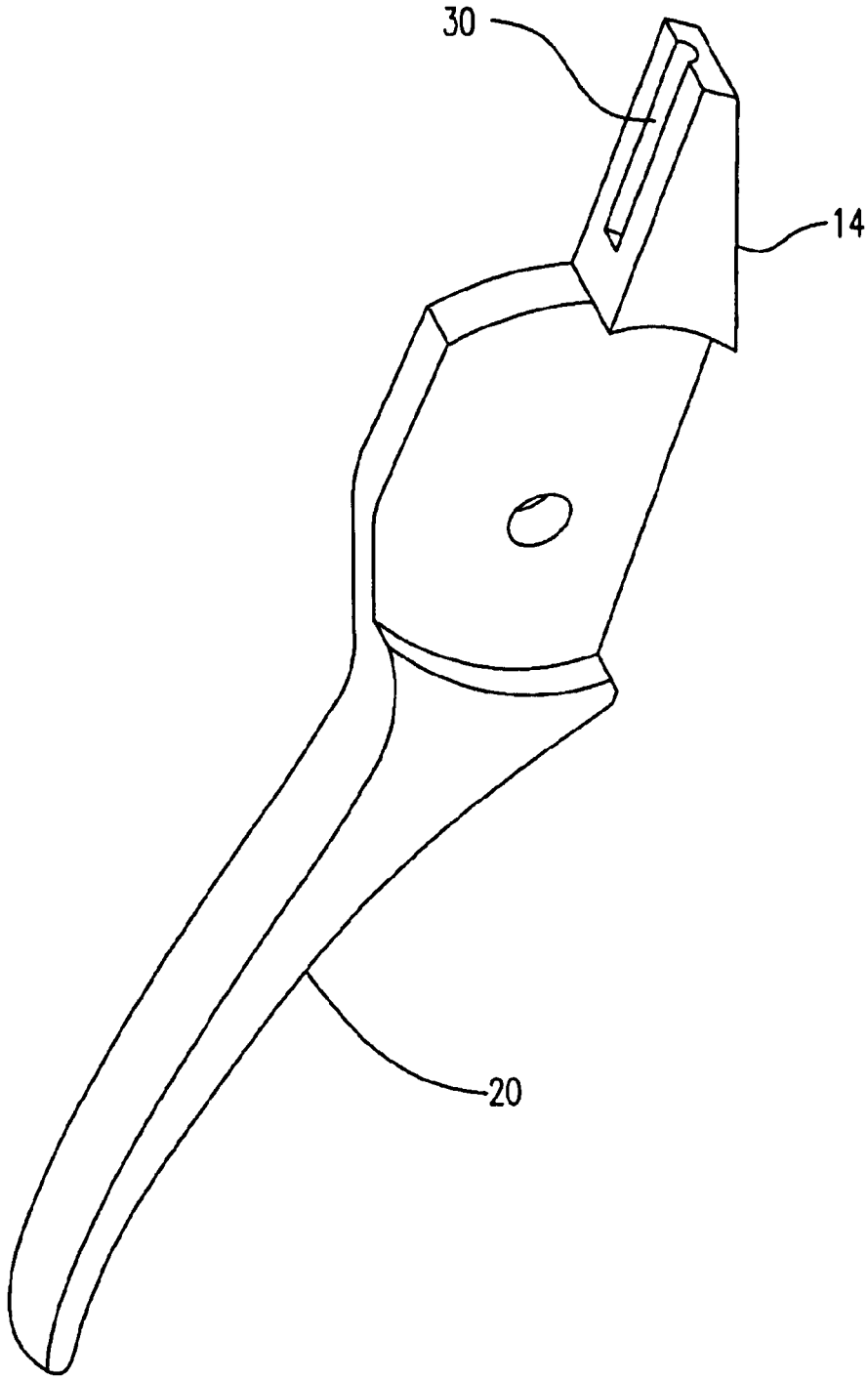
FIG. 6 is a fragmentary perspective view of one pliers jaw showing certain aspects of the present invention.

A generally cylindrical threaded member 32 is received in the bore 23. A majority portion of the threaded member is located in the first jaw 12, and a minority portion extends past the closing plane 16 and projects out of the face of the first jaw 12. It is to be understood that at least the majority portion 28 of the bore 23 is threaded to receive and retain member 32. The minority portion 30 of the bore 23 in jaw 14 may be threaded, but is preferably a smooth cylindrical surface, as shown in most clearly in FIG. 6. Having a smooth bore portion 30 in jaw 14 will facilitate closure of jaws together at the closing plane 16 even if the threads of the minority portion of the cylindrical member 23 are damaged.

Figure 7:
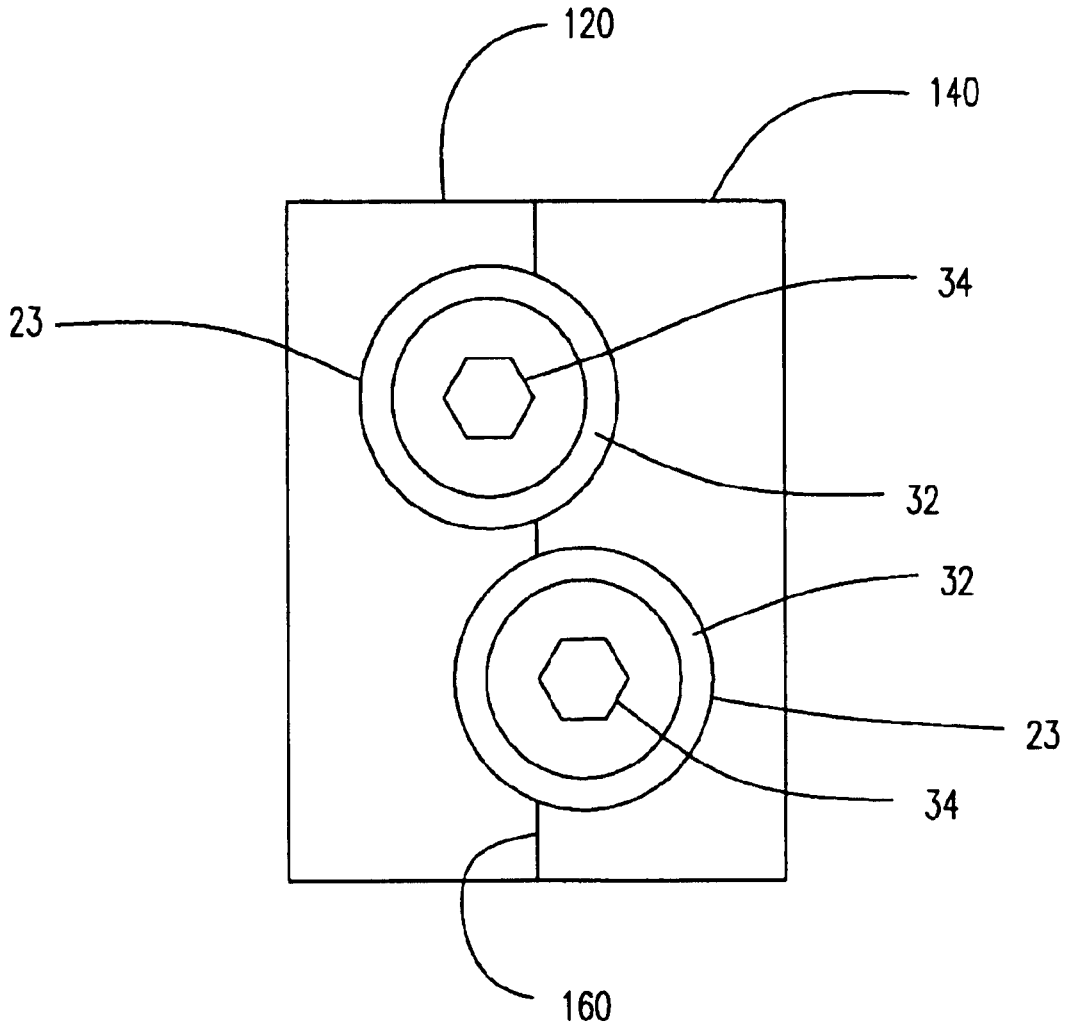
FIG. 7 is a simplified end view similar to that of FIG. 2, except showing an alternative embodiment of the present invention.
Figure 11:
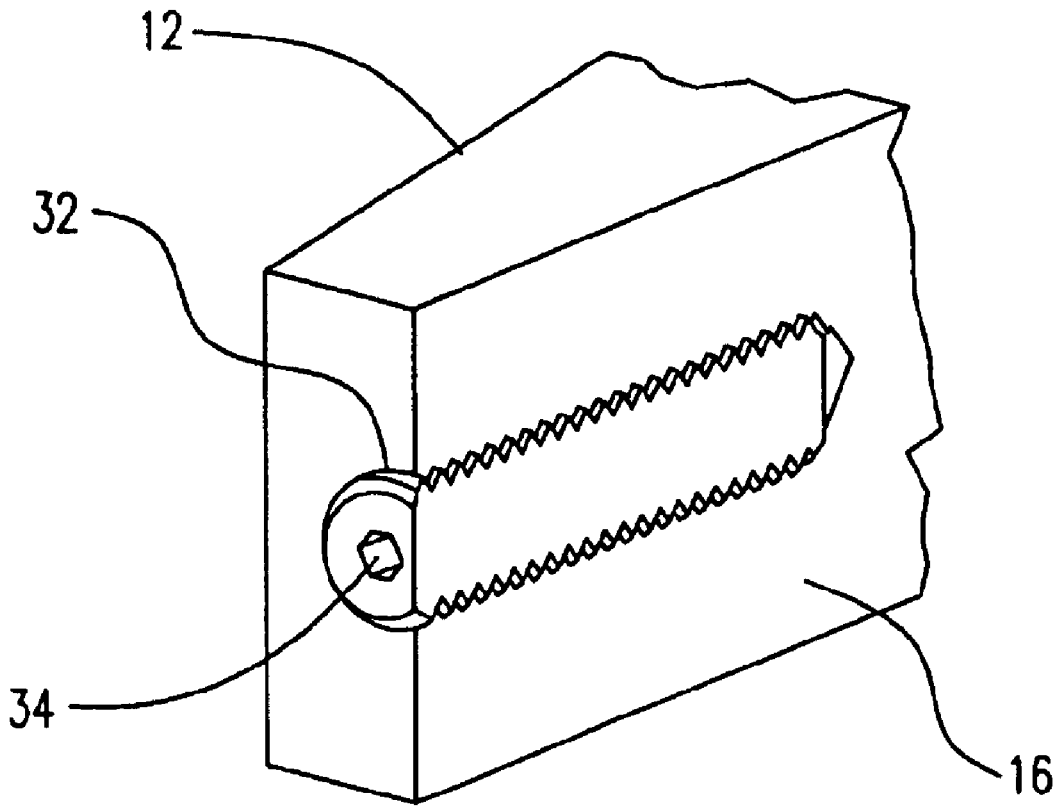
FIG. 11 is a fragmentary perspective view showing a portion of damaged threads removed from a cylindrical insert useful in the practice of renewing the gripping aspect of the present invention.
Figure 12:
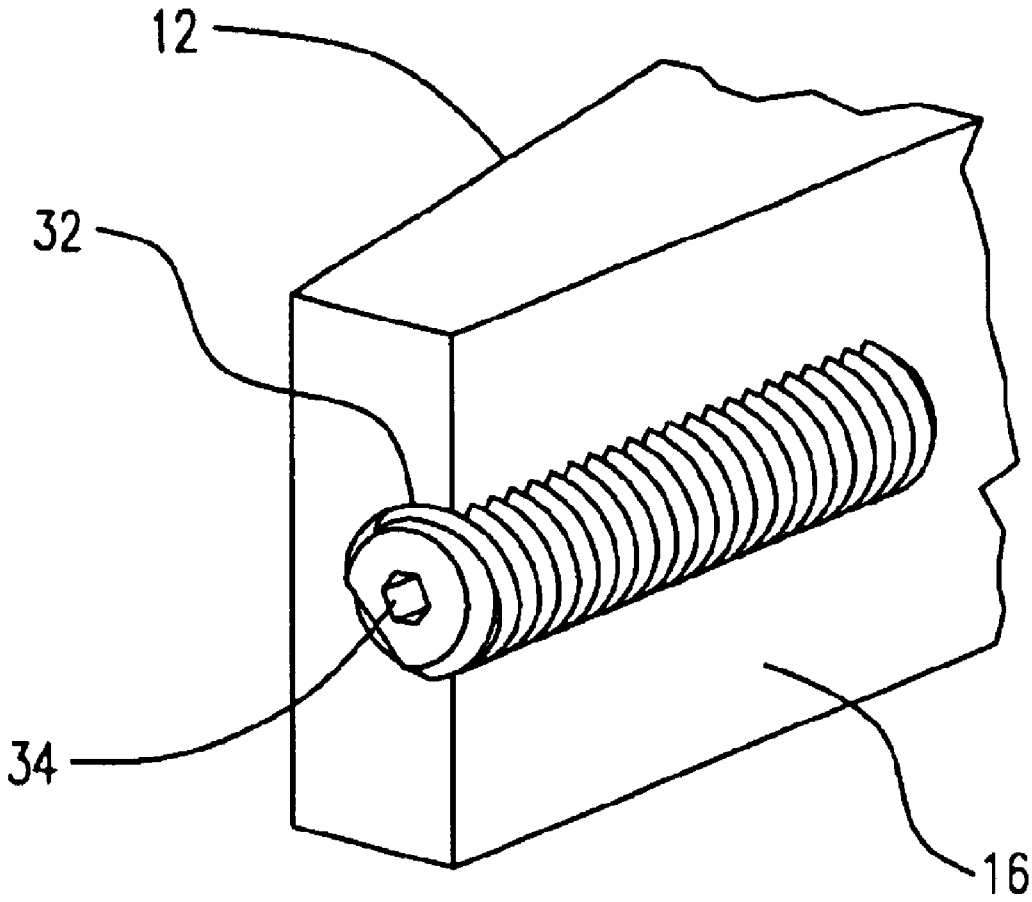
FIG. 12 is a fragmentary perspective view similar to that of FIG. 11, after the cylindrical insert has been rotated to renew the gripping aspect of the present invention.

A hexagonal relief 34 is preferably formed in an end of member 32 as may be seen most clearly in FIGS. 7, 11 and 12. Relief 34 is preferably sized to accept a conventional Allen wrench to rotatingly drive member 32 into or out of the threads in the majority portion 28 of the bore 23. Alternatively, other configurations or integral engagement means may be formed in the end of member 32, such as a conventional screwdriver slot or the like.

Preferably, the threads in the majority portion 28 of the bore 23 and the threads of the cylindrical member 32 have the same nominal size, pitch and lead angle, such that the cylindrical member 32 is freely received in bore 23. A conventional set screw 36 may be received in a threaded cross bore 38 to retain member 32 in jaw 12. Alternatively, the threaded member 32 and the majority portion 28 of the bore 23 may have an interference fit therebetween, or other means such as an anaerobic adhesive may be used to secure member 32 in bore 23, in which case the set screw 36 may be omitted.

Figure 8:
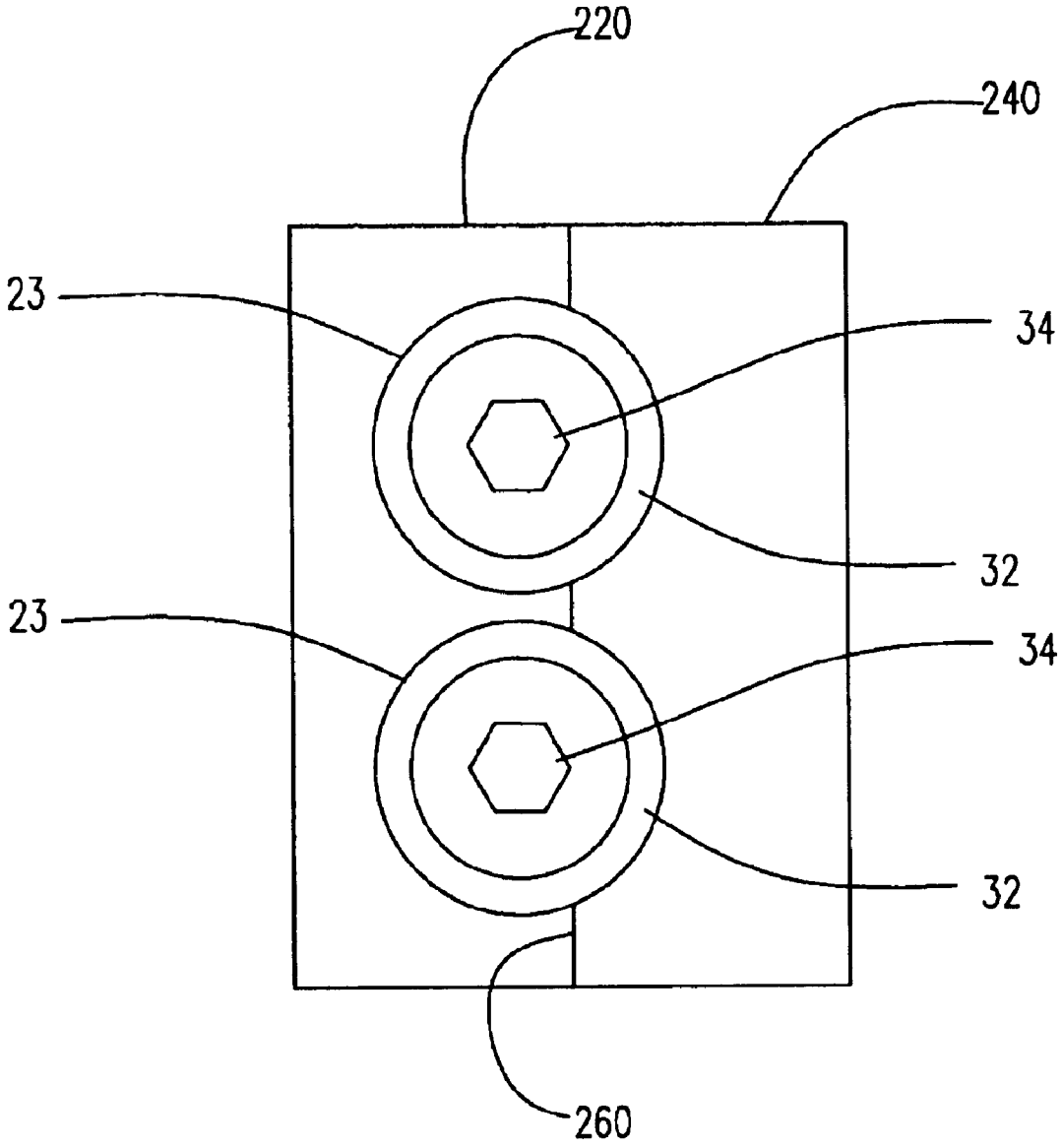
FIG. 8 is a simplified end view similar to that of FIG. 2, except showing an alternative embodiment of the present invention.
Figure 9:
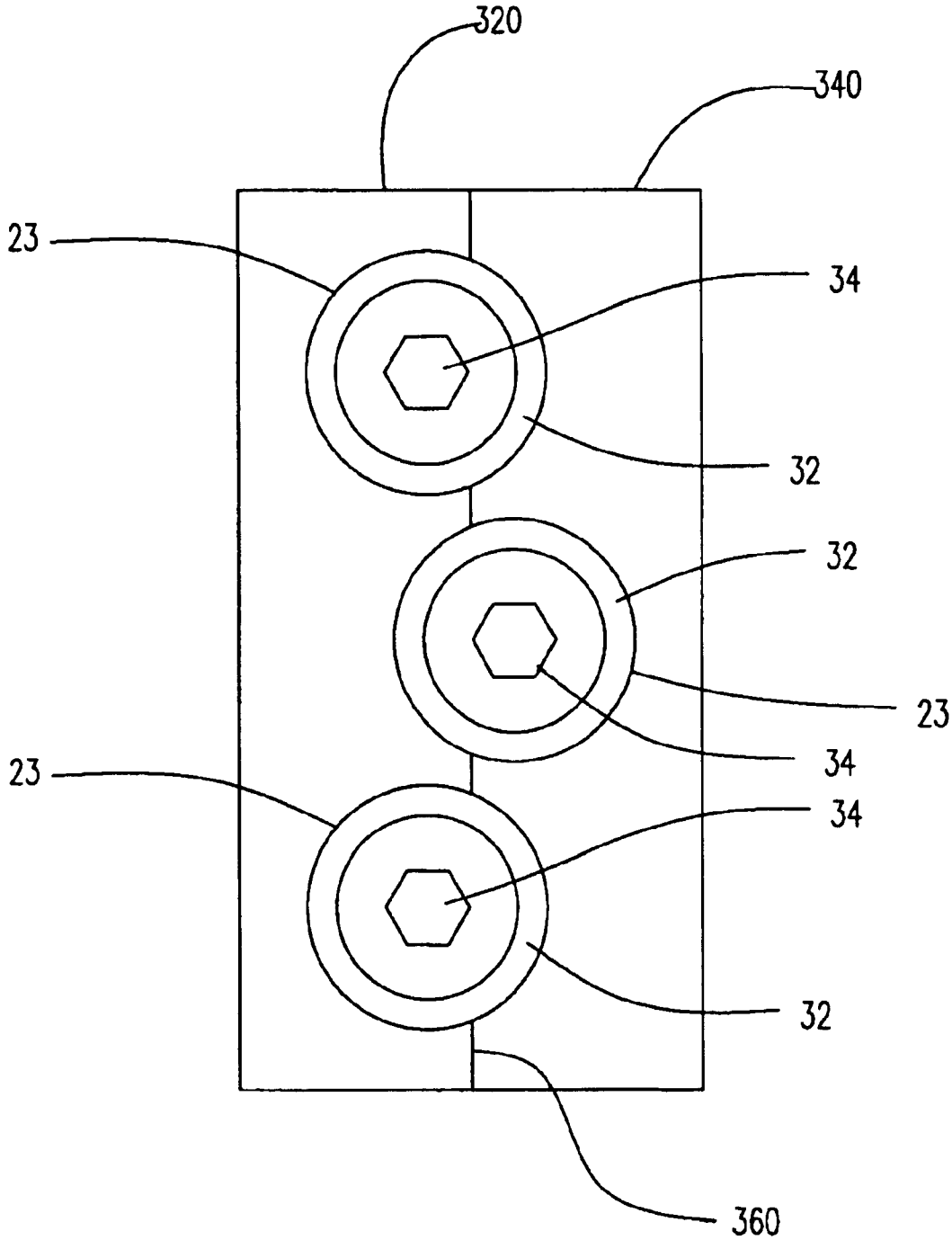
FIG. 9 is a simplified end view similar to that of FIG. 2, except showing an alternative embodiment of the present invention.

Referring now to FIGS. 7, 8 and 9, it is to be understood to be within the scope of the present invention to replicate the bore 23 and threaded member 32 in the same pliers, such that the jaws 120, 140 are identical to each other as shown in FIG. 7. Alternatively, two (or more) cylindrical members 32 may be received in corresponding bores 23 in only one of the jaws 220, 240, as shown in FIG. 8. Still further alternatives are to have additional members 32 in the jaws 320, 340 as shown in FIG. 9. Thus various degrees of gripping surface may project or extend past the closing plane 160, 260, or 360 respectively, as desired.

Figure 10:
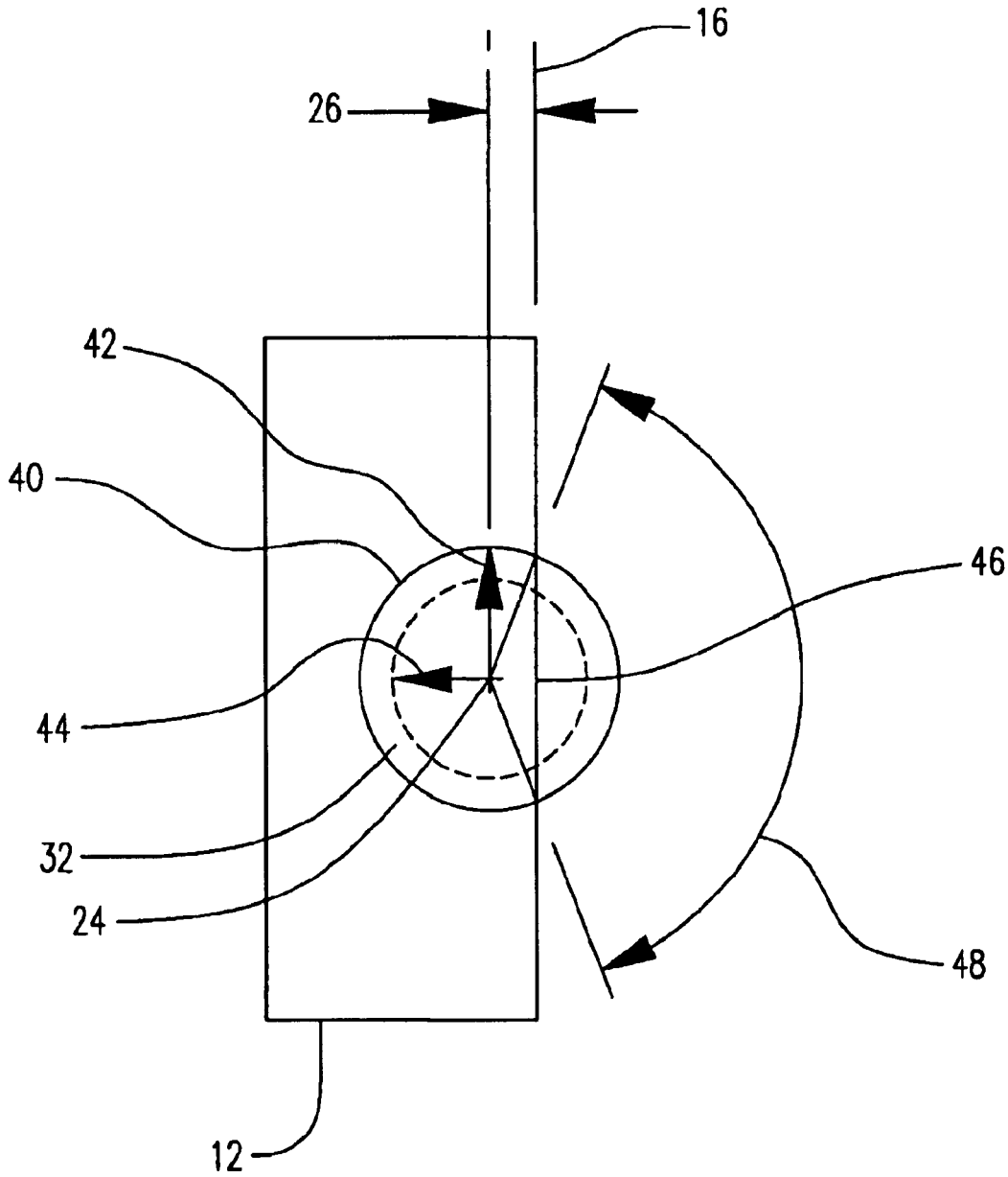
FIG. 10 is a simplified end view similar to that of FIG. 2, showing a chord of a circular cross section of a cylinder intersecting a closing plane and showing a pair of radii intersecting the ends of the chord.

Referring now to FIG. 10, cylindrical member 32 has a major cylinder 40 defined as an imaginary cylinder intersecting the crests of the external thread formed on member 32. The radius of major cylinder 40 is indicated by arrow 42, while arrow 44 indicates the radius of a minor cylinder of member 32, defined to be an imaginary cylinder intersecting the roots of the external thread of cylindrical member 32. In FIG. 10, the closing plane 16 intersects the major cylinder 40 of the threaded member 32 in a chord 46. An angle 48 is formed by a pair of radii intersecting the end points of chord 46, defining the boundary of the exposed, minority portion of member 32 that extends beyond the closing plane 16 of jaw 12.

While it is contemplated that in use, the gripping surface formed by the minority portion of one or more cylindrical members 32 projecting or extending beyond the closing plane may become worn or deformed, lowering the gripping capability thereof, the present invention also contemplates renewing the gripping surface of the present invention as follows.

When the gripping surface is to be renewed, an Allen wrench is inserted into the relief 34 and the threaded cylindrical member 32 is rotated out of the threaded bore 23. If the threads on member 32 are too deformed to permit removal, the deformed or damaged portion of the threads are desirably removed from the exposed minority portion of the cylindrical member 32, by filing off or otherwise removing the damaged threads from the portion of the threaded member 32 extending beyond the closing plane 16, as illustrated in FIG. 11. Once the damaged minority portion of member 32 is removed, member 32 is rotated by an angle at least equal to the angle 48 formed by the intersection of the radii and chord of member 32, to the position shown in FIG. 12, after which a new, undamaged portion of the threads of member 32 are exposed in the minority portion extending beyond the closing plane 16, renewing the gripping surface. Once the threads are sufficiently "consumed" by use, the member 32 is desirably replaced using the Allen wrench or other installation tool (not shown).

Figure 13:
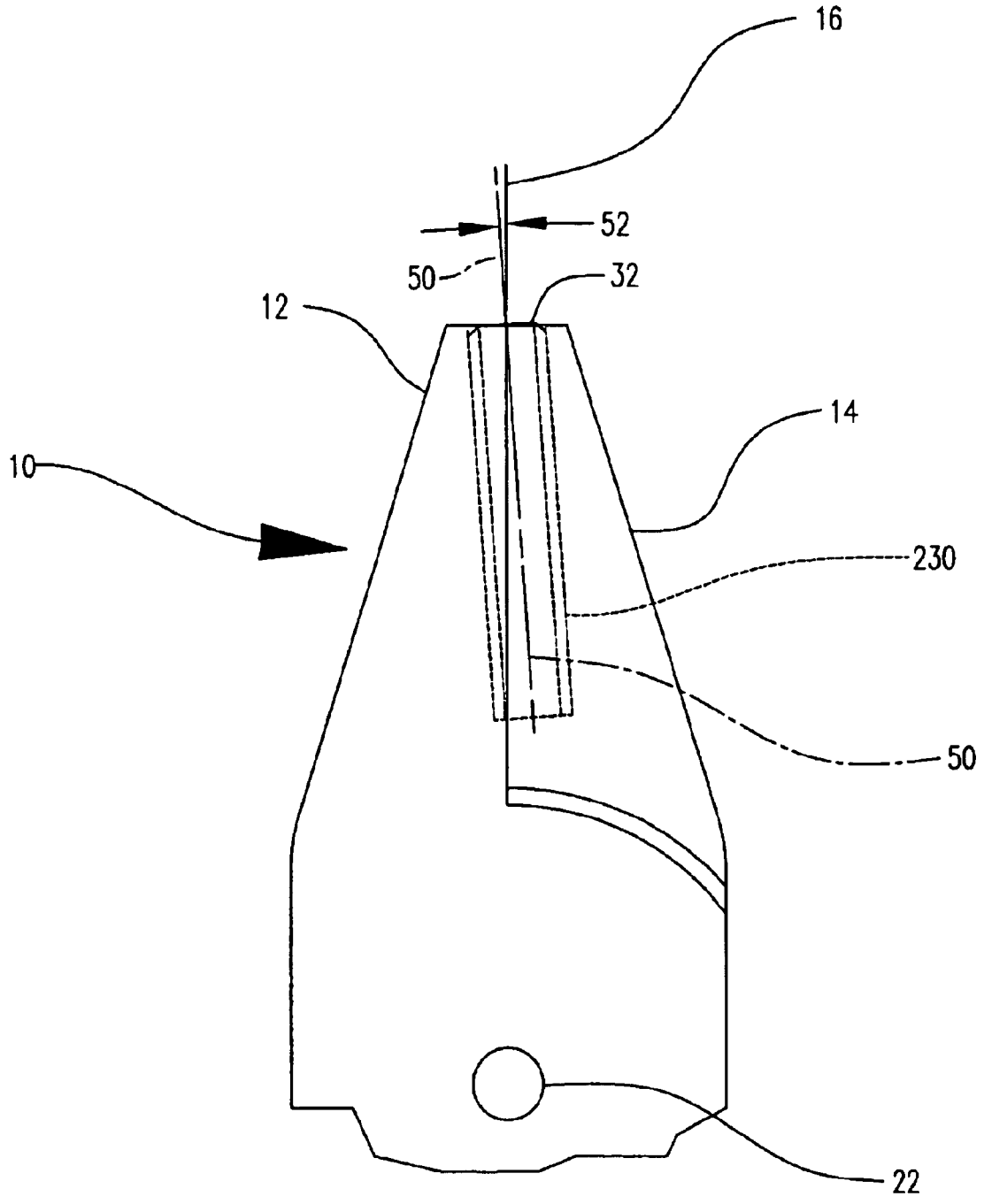
FIG. 13 is a fragmentary view similar to the view of FIG. 1, except with the cylindrical insert installed along an axis angularly offset from a closing plane of the jaws of the pliers.

Referring now most particularly to FIG. 13, another embodiment of the present invention may be seen. In this embodiment, bore 230 has a cylindrical axis 50 angularly offset at an angle 52 from the closing plane 16. In this embodiment, the cylindrical threaded member 32 effectively recedes into jaw 14 as the bore proceeds deeper into the jaws toward the pivot member 22. The majority portion of the bore and the cylindrical member is located in jaw 14 in this embodiment, and the minority portion of both the bore and the cylindrical threaded member extend progressively beyond the closing plane 16 into a recess in jaw 12, which may be threaded or smooth to matingly receive the progressively projecting minority portion of the threaded gripping member. To renew this embodiment, a generally parabolic flat is filed on the exposed minority portion of the gripping member, with the flat preferably parallel to the closing plane 16. The gripping member is then rotated to expose undamaged threads beyond the closing plane.

When the pliers are to be non-sparking, or non-magnetic or non-scratching, the jaws and handles are preferably made of basic aluminum bronze (approximately 82% Copper, 10% Aluminum, 5% Nickel and 3% Iron) and the cylindrical member is preferably made of beryllium copper (about 2% Beryllium, 98% Copper) and hardened to about HRC 46. The pivot member 22 may also be made of beryllium copper, if desired. It is to be understood to be within the scope of the present invention, however, to make the pliers or the gripping member 32 (or both) out of steel, if desired.

This invention is not to be taken as limited to all of the details thereof as modifications and variations thereof may be made without departing from the spirit or scope of the invention.

What is claimed is:

1. Apparatus for replaceable gripping member in pliers jaw comprising:

a. a pair of pliers having first and second movable opposed jaws meeting at a closing plane for gripping and integral handles for opening and closing the jaws;

b. a bore located in the jaws and having:

i. an axis offset from the closing plane, ii. a majority portion in the first jaw on one side of the closing plane, and iii. a minority portion in the second jaw on the other side of the closing plane; and c. a generally cylindrical threaded member received in the bore having a majority portion of the threaded member in the first jaw and a minority portion extending past the closing plane.

2. The apparatus of claim 1 wherein the minority portion of the bore in the second jaw includes a recess for receiving the minority portion of the threaded member such that the jaws are permitted to substantially meet at the closing plane.

3. The apparatus of claim 1 wherein the axis of the threaded bore is parallel to the closing plane.

4. The apparatus of claim 1 wherein the minority portion of the threaded member extending past the closing plane is less than fifty percent of the volume of the threaded member.

5. The apparatus of claim 1 wherein the majority portion of the bore is threaded.

6. The apparatus of claim 5 wherein the threads of the majority portion of the bore and the threads of the threaded member have the same nominal size, pitch, and lead angle.

7. The apparatus of claim 1 wherein the threaded member and the majority portion of the bore have an interference fit therebetween.

8. The apparatus of claim 1 wherein the minority portion of the bore is threaded.

9. The apparatus of claim 1 wherein the minority portion of the bore is substantially free of threads.

10. The apparatus of claim 1 wherein the threaded member has integral engagement means for installing and removing the threaded member from the majority portion of the bore.

11. The apparatus of claim 10 wherein the integral engagement means comprises a hexagonal recess in an end of the threaded member.

12. The apparatus of claim 1 wherein the bore comprises a first bore, and the threaded member comprises a first threaded member, and the apparatus further comprises a second bore and second threaded member.

13. The apparatus of claim 12 wherein the second bore and the second threaded member each has a majority portion in the first jaw and the second threaded member has a minority portion extending past the closing plane.

14. The apparatus of claim 12 wherein the second bore and the second threaded member each has a majority portion in the second jaw and the second threaded member has a minority portion extending past the closing plane.

15. The apparatus of claim 1 further comprising:

d. means for securing the threaded member in the first jaw.

16. The apparatus of claim 15 wherein the means for securing the threaded member is a set screw.

17. A method of providing a gripping surface in a pliers jaw comprising the steps of:

a. receiving a threaded member in a bore in a pliers jaw having a closing plane on a working surface thereof and wherein the threaded member has a majority portion within the jaw and a minority portion extending beyond a closing plane of the jaw such that the closing plane intersects a major cylinder of the threaded member in at least one chord; and b. rotating the threaded member by an angle at least equal to the angle formed by a pair of radii intersecting the end points of the chord such that a threaded portion within the jaw is rotated to extend beyond the closing plane of the jaw.

18. The method of claim 17 further comprising an intermediate step a1 between steps a and b:

a1. removing damaged threads from the portion of the threaded member extending beyond the closing plane.

19. The method of claim 18 wherein the removing step a1, comprises filing the damaged threads off the threaded member.

20. Non-sparking pliers apparatus having a replaceable gripping member, the apparatus comprising:

a. a pair of pliers having first and second movable opposed jaws meeting at a closing plane for gripping and integral handles for opening and closing the jaws, with the jaws and handles formed of aluminum bronze;

b. a bore located in the jaws and having:

i. an axis offset from the closing plane, ii. a majority portion in the first jaw on one side of the closing plane, and iii. a minority portion in the second jaw on the other side of the closing plane; and c. a generally cylindrical threaded member formed of beryllium copper received in the bore having a majority portion of the threaded member in the first jaw and a minority portion extending past the closing plane.

* * * * *